US007716761B1

(12) United States Patent
Gilstad et al.

(10) Patent No.: US 7,716,761 B1
(45) Date of Patent: May 18, 2010

(54) ADAPTIVE POSITIONING SYSTEM

(76) Inventors: Dennis W. Gilstad, 3522 Hunters Sound, San Antonio, TX (US) 78230; Barbara C. Gilstad, 3522 Hunters Sound, San Antonio, TX (US) 78230; Elizabeth A. McGuigan, 4025 Jones Bridge Rd., Chevy Chase, MD (US) 20815; John R. H. Gilstad, Naval Hospital Yokosuko, PSC 475, Box 1723, FPO AP (JP) 96350

( * ) Notice: Subject to any disclaimer, the term of this patent is extended or adjusted under 35 U.S.C. 154(b) by 606 days.

(21) Appl. No.: 11/693,747

(22) Filed: Mar. 30, 2007

Related U.S. Application Data

(63) Continuation-in-part of application No. 11/198,578, filed on Aug. 5, 2005, now abandoned, and a continuation-in-part of application No. 11/175,811, filed on Jul. 6, 2005, now abandoned.

(51) Int. Cl.
*A47B 7/00* (2006.01)

(52) U.S. Cl. ..... 5/607; 5/425; 5/428

(58) Field of Classification Search ..... 5/607, 5/942, 613, 657, 722, 723, 691, 609, 424, 5/425, 428; 108/6–8
See application file for complete search history.

(56) References Cited

U.S. PATENT DOCUMENTS

| | | | | | |
|---|---|---|---|---|---|
| 154,060 | A | * | 8/1874 | Mahler | 5/610 |
| 3,327,328 | A | * | 6/1967 | Slivoski | 5/661 |
| 4,375,706 | A | | 3/1983 | Finnhult | |
| 4,531,417 | A | | 7/1985 | Hollman | |
| 4,658,450 | A | * | 4/1987 | Thompson | 5/607 |
| 4,658,451 | A | * | 4/1987 | Taniguchi | 5/607 |
| 4,910,818 | A | | 3/1990 | Grabill et al. | |
| 5,101,519 | A | | 4/1992 | Yamamoto | |
| 5,125,122 | A | | 6/1992 | Chen | |
| 5,170,364 | A | | 12/1992 | Gross et al. | |
| 5,224,228 | A | | 7/1993 | Larrimore | |
| 5,299,334 | A | | 4/1994 | Gonzalez | |
| 5,303,437 | A | * | 4/1994 | Hung | 5/613 |
| 5,479,665 | A | * | 1/1996 | Cassidy et al. | 5/613 |
| 5,515,561 | A | | 5/1996 | Suggitt et al. | |
| 5,640,729 | A | * | 6/1997 | Marino | 5/607 |
| 5,653,665 | A | | 8/1997 | Neeley | |
| 5,799,533 | A | | 9/1998 | Seki et al. | |
| 5,826,286 | A | * | 10/1998 | Cranston | 5/606 |
| 6,073,288 | A | | 6/2000 | Berenstein | |

(Continued)

*Primary Examiner*—Peter M. Cuomo
*Assistant Examiner*—William Kelleher
(74) *Attorney, Agent, or Firm*—Dennis W. Gilstad

(57) ABSTRACT

An adaptive positioning system embodiment comprises a plurality of longitudinal elements. At least one frame member has an adjustably fixed spatial relationship with a plurality of longitudinal elements, thus forming a conforming assembly capable of supporting a person. The conforming assembly is supported by support means comprising at least one bearing and facilitating rotation (by rotation means) of the conforming assembly (and a supported person) about a longitudinal axis. Control means generate at least one control signal for controlling the rotation means to adapt the positioning system to an individual person, at least one control signal encoding at least one set point and a function of weight distribution on the conforming assembly. The function of weight distribution may be nonlinear. At least one optional multiuse port and/or one or two multiuse optional lateral reverse-foldable longitudinal assemblies may be added to the conforming assembly.

7 Claims, 8 Drawing Sheets

U.S. PATENT DOCUMENTS

| | | | | |
|---|---|---|---|---|
| 6,374,440 | B1 | 4/2002 | Thim, Jr. | |
| D467,093 | S * | 12/2002 | Brophy | D6/391 |
| 6,505,365 | B1 | 1/2003 | Hanson et al. | |
| 6,601,462 | B1 | 8/2003 | Ueno et al. | |
| 6,651,281 | B1 * | 11/2003 | Figiel | 5/612 |
| 6,691,348 | B2 | 2/2004 | Plummer et al. | |
| 6,708,358 | B2 | 3/2004 | Hensley | |
| 6,807,698 | B2 | 10/2004 | Torbet et al. | |
| 6,862,761 | B2 | 3/2005 | Hand et al. | |
| 6,916,056 | B2 * | 7/2005 | Mitchell et al. | 296/20 |
| 2002/0111767 | A1 | 8/2002 | Lueschow et al. | |
| 2005/0160530 | A1 * | 7/2005 | Taguchi et al. | 5/618 |
| 2006/0117483 | A1 * | 6/2006 | Devitt | 5/621 |
| 2008/0222811 | A1 * | 9/2008 | Gilbert et al. | 5/607 |

* cited by examiner

ADAPTIVE POSITIONING SYSTEM

This patent application is a continuation-in-part application (CIP) claiming the benefit of copending U.S. patent application Ser. No. 11/198,578 (filed Aug. 5, 2005) entitled MEDICAL PROCEDURES POSITIONING SYSTEM, which is a continuation-in-part (CIP) of U.S. patent application Ser. No. 11/175,811 (filed Jul. 6, 2005) entitled ARTICULATED BED (abandoned). The present application is also related to copending U.S. patent application Ser. No. 11/677,058 (filed Feb. 21, 2007) entitled ADAPTIVE ARTICULATED BED.

FIELD OF THE INVENTION

The invention relates generally to adjustable beds and patient positioning systems.

BACKGROUND

Recurrent and chronic pain, especially that originating in the lower back and/or neck, are common medical complaints for which the recommended treatments range from conservative (e.g., bed rest) to highly invasive (e.g., spinal surgery followed by bed rest). Treatment recommendations vary because no single mode of therapy has been generally recognized as superior. Each treatment choice is associated with its own costs and side effects, but recovery is typically prolonged, painful and expensive regardless of the choice. See, e.g., U.S. Pat. No. 5,653,665, which is incorporated herein by reference. And the pain may be aggravated by poor sleeping habits (e.g., a tendency to sleep face-down). See, e.g., U.S. Pat. No. 6,073,288, which is incorporated herein by reference. The resulting state of chronic pain predisposes patients to insomnia and excessive use of medication, thus increasing the cost of medical care and risking the development of dependency.

Chronic pain that is actually precipitated or aggravated by bed rest is also often reported by patients confined to bed for reasons such as accidental injuries or cancer. A common condition in all such periods of bed rest is that the patients are often not really at rest. Rather, they are propped in a variety of positions that are moderately comfortable for only a limited time. Movement out of these positions typically induces more pain. See, e.g., U.S. Pat. No. 6,807,698 B2, which is incorporated herein by reference (hereinafter the '698 patent).

For some bed-ridden patients, movement is so restricted by the attendant pain that blood circulation and respiration are sufficiently compromised to lead to development of decubitus ulcers and/or pulmonary complications. Attentive nursing care can alleviate such problems, but at relatively high cost. Several therapeutic beds have been proposed to provide a minimal level of patient movement in the form of controlled oscillatory support. See, e.g., the '698 patent as well as U.S. Pat. Nos. 5,299,334, and 6,691,348 B2, and 6,708,358 B2 and 6,862,761 B2, which are incorporated herein by reference (hereinafter the '334 patent, the '348 patent, the '358 patent and the '761 patent respectively).

To support an immobilized patient, the '334 patent discloses a generally rectangular patient support table that can be pivoted about transverse and longitudinal axes. The '348 patent describes features alleviating the drawbacks and difficulties of prior art beds for a bed-ridden patient who is physically unable to move himself. Both the '334 and the '348 patents describe structures to restrain or limit movement of a patient's body during tilting or tipping of a bed (i.e., preventing a patient from falling off the bed). But neither '334 patent nor the '348 patent describe features designed to allow a patient to move by himself or herself so as to assume and/or adjust postures commonly observed in natural sleep (e.g., a lateral recumbent position with knees and hips flexed, a position known to relieve lower back pain). See, e.g., U.S. Pat. No. 4,910,818, which is incorporated herein by reference, and U.S. Pat. No. 6,374,440 B1, which is incorporated herein by reference (hereinafter the '440 patent).

A person lying in a right lateral recumbent position (i.e., with the person's weight being supported primarily by the person's right side), with knees and hips flexed to relieve lower back pain, is shown schematically in FIG. 1 of the '440 patent. While this position is temporarily beneficial and may even induce sleep, the weight of the patient's uppermost arm, combined with muscle relaxation that accompanies sleep, tends to twist the patient's upper torso into a face-down position while the flexed knees and hips prevent the patient's lower body from turning with the upper torso. The result is a twisting of the patient's spine which can aggravate lower back pain.

SUMMARY OF THE INVENTION

The invention includes methods and apparatus related to various embodiments of an adaptive positioning system that facilitates research, diagnosis, and treatment related to persons supported on the positioning system. Rotation of a supported person about longitudinal and/or transverse axes, with simultaneous and/or delayed processing of data related to spontaneous and/or induced movement of the person, aids clinical assessment of neuromuscular and related problems while placing and/or maintaining a person in a relatively favorable position (e.g., to facilitate diagnosis or treatment, to relieve pain and/or to promote rest). Real-time recording of raw and processed data allow further processing, including comparisons of individual responses within clinical classifications and group studies to assess efficacy.

One embodiment of an adaptive positioning system comprises a plurality of longitudinal elements and at least one frame member having an adjustably fixed spatial relationship with a plurality of the longitudinal elements, thus forming a conforming assembly capable of supporting a person. The conforming assembly is rotatably supported (as on one or more longitudinal bearings) by support means and is shaped to conform at least partially to a person supported on the assembly. Hence, rotation (by rotation means) of the conforming assembly (via at least one frame member) about a longitudinal axis tends to also rotate a supported person thereon about a longitudinal axis. Note that where edge-to-edge pivotal connection is described herein, physical connection may be achieved either at or closely adjacent to the respective edges as, for example, by a hinged joint.

Rotary motion about a longitudinal axis of at least one frame member having an adjustably fixed spatial relationship with a plurality of the longitudinal elements of a conforming assembly tends to cause rotation about a longitudinal axis of a person supported on the assembly, and tends to change the weight distribution of a supported person on the assembly. A function of any such change of weight distribution may comprise one or more variables such as, e.g., changing pressure on one or more of the individual longitudinal elements, changing torque values on one or more longitudinal elements, and/or changing torque about support means bearings. Further, a supported person may move spontaneously or move in conjunction with conforming assembly rotation about a longitudinal axis, and moves of either or both kinds may in general be reflected by changes in a function of one or more variables related to weight distribution on the conforming assembly. Such variables are detected by one or more sensors on the adaptive positioning system.

Control means generate at least one control signal combining one or more such functions of weight distribution with one or more set points representing predetermined angular orientations (e.g., those related to mechanical limitations and/or safety) of a supported person about longitudinal and/or transverse axes. Angular positions of a conforming assembly about longitudinal and/or transverse axes can be adapted for individual persons for diagnosis and/or treatment, to achieve, maintain or increase personal comfort, and/or to reduce personal discomfort. Angular position changes to accomplish such adaptations are achieved via at least one control signal generated by at least one processor component (comprising, e.g., a computer) of the control means, the control signal encoding the combination of at least one set point and a function of weight distribution on the conforming assembly.

The control signal(s) control one or more motive components of the rotation means to achieve desired rotation of a supported person about a longitudinal and/or transverse axis. Since rotation means comprises at least one motive component (e.g., electric motors and/or fluid-actuated cylinders), a control signal may comprise a plurality of signal components such as one or more electrical voltages (transmitted to motive components, e.g., wirelessly or via one or more electrical conductors) and/or one or more pressurized fluids (transmitted to motive components, e.g., via one or more pipes or tubes). Signal components and control signals themselves may be encoded (i.e., multiplexed) so as to address a subset of motive components.

An embodiment of an adaptive positioning system schematically illustrated herein comprises a plurality of substantially planar longitudinal elements, each longitudinal element having first and second longitudinal edges and first and second ends (see, e.g., FIG. 1 and U.S. Pat. No. 5,224,228, incorporated herein by reference, herein the '228 patent). At least one frame member has an adjustably fixed spatial relationship with each longitudinal element. Such an adjustably fixed spatial relationship may be achieved, for example, through one or more reversibly lockable hinges (see, e.g., FIG. 1 and U.S. Pat. No. 4,531,417, incorporated herein by reference, herein the '417 patent). Such hinges may pivotally connect longitudinal edges of the longitudinal elements to each other and/or to at least one frame member to form a conforming assembly configurable in a predetermined shape capable of rotating a supported person about a longitudinal axis. The conforming assembly has first and second side edges.

Alternatively, first and second ends of a plurality of longitudinal elements may be adjustably fixed to head and foot frame members respectively to form a conforming assembly configurable in a predetermined shape capable of rotating a supported person about a longitudinal axis. In such an alternative embodiment, adjustable fixation of longitudinal element ends to one or more frame members (e.g., to head and foot frame members) may obviate the need for pivotal edge-to-edge connection of longitudinal element as described above.

In the schematically illustrated embodiment of FIG. 1, support means support the conforming assembly above a floor and comprise a longitudinal bearing, one or more bearing supports, and base members. Bearing supports such as those of FIG. 1 may incorporate one or more adjustable length elements to facilitate height adjustment of the conforming assembly and/or rotation of the conforming assembly about a transverse axis. When such adjustable length elements are present, the longitudinal bearing is pivotally mounted to bearing supports. Components of support means may take a variety of forms analogous in part to, for example, the undercarriage 11 of the '228 patent, or the base 22 of the '761 patent, structure 10 of the '334 patent, or structure 212 of the '358 patent. Support means in general comprise at least one longitudinal bearing (see, e.g., FIG. 1). Each longitudinal bearing, in turn, facilitates rotation about at least one longitudinal axis of the conforming assembly.

Rotation means of the schematically illustrated embodiment of FIG. 1 facilitate angular rotation of the conforming assembly to a predetermined angular position about a longitudinal axis. Components of rotation means may take a variety of forms analogous in part to, for example, the mover 19 of the '761 patent, the motors 56 and 56A with extensible and retractable cylindrical screws 60 and 60A respectively of the '228 patent, the hydraulic pump 12 with hydraulic cylinders of the '334 patent, or the carriage 230 carrying the drive systems 250 and 252 of the '358 patent.

Control means generate at least one control signal for control of rotation means, the control signal encoding at least one set point and at least one function of weight distribution on a conforming assembly. The function may be linear or nonlinear, and control means to generate the function (see FIG. 1) comprise at least one processor, at least one set point input device connected to the processor(s), at least one sensor for weight distribution information, and at least one transmission line for carrying a control signal and/or weight distribution information obtained from one or more sensors on a conforming assembly. Additional control means components such as computers, data storage devices and transmission lines may be added, for example, to collect, analyze, apply and store weight distribution data and/or physiologic measurements specified in research protocols. Such additional control means components can provide feedback on a supported person's response to conforming assembly rotation(s), and treatment protocols may thus be adapted to increase the likelihood of one or more desired responses.

Note that with appropriate matching of modality for control signals and weight distribution information (e.g., electrical, pneumatic or hydraulic), and any needed switching, a single transmission line may alternately carry, for example, a control signal and weight distribution information. Each variable included in the function of weight distribution on a conforming assembly, as well as physiologic measurements is obtainable from sensors on the positioning system and/or from an appropriately instrumented person supported on the positioning system.

In alternative embodiments, the conforming assembly may additionally comprise one or two multiuse lateral reverse-foldable longitudinal assemblies pivotally, and reversibly-lockably, connected longitudinally edge-to-edge (e.g., as by a longitudinal reversibly-lockable hinge) to the first and/or second conforming assembly side edges. Such lateral reverse-foldable longitudinal assemblies may be folded away to facilitate access or may function, for example, as bed rails, to assist personal movement to or from a conforming assembly, or when configured as described below, to support weight over the conforming assembly.

Each lateral reverse-foldable longitudinal assembly comprises a plurality of foldable and reversibly-lockable longitudinal elements. Schematically illustrated examples herein include an inner foldable element pivotally, and reversibly-lockably connected longitudinally (e.g., as by a longitudinal reversibly-lockable hinge) to an outer foldable element so that the outer foldable element can rotate about one or more longitudinal axes between a reversibly-locked first position (e.g., a closed position) and a reversibly-locked second position (e.g., an extended position). Through rotation of the adjacent inner foldable element, an outer foldable element in an extended position may thus be positionable to support weight (e.g., a hand grip for a supported person) over a portion of the conforming assembly. When two lateral reverse-foldable longitudinal assemblies are present with their respective outer foldable elements in extended position, the respective outer foldable elements may be temporarily joined and locked longitudinally, edge-to-edge, for supporting weight (e.g., a small winch for lifting a patient) over a portion of the conforming assembly.

Alternative embodiments of the adaptive positioning system may also comprise one or more longitudinal elements which, in turn, comprise at least one multiuse port for allowing access to a patient supported on the conforming assembly. Such a port may comprise, for example, an individually hinged or removable portion of the longitudinal element. Alternatively, such a port may comprise a longitudinal slot in a longitudinal element, with one or more longitudinally movable supports having a cumulative length less than that of the slot and being slidingly secured within the slot. Each hinged or removable portion comprising a port may be opened without materially affecting support of a patient on the conforming assembly, while providing sufficient clearance to allow procedures such as physical examination of the patient or spinal puncture. Alternatively, one or more longitudinally movable supports may be moved longitudinally in a slot to distribute support for a patient along the slot while simultaneously allowing flexible access to a patient via a movable port optionally locatable at any of a variety of positions along the slot.

The shape of a conforming assembly is a function of the relative spatial relationships among its longitudinal elements. Since at least one frame member has an adjustably fixed spatial relationship with each longitudinal element, the shape can be adapted to comfortably accommodate the body habitus and weight distribution of an individual patient. In use, the conforming assembly's shape, as well as its angular position (relative, e.g., to support means) about one or more longitudinal axes (and optionally about one or more transverse axes), is adapted to comfortably support a patient. The coupling between the support means and the conforming assembly provides, in various embodiments, for rotation of the conforming assembly (and thus rotation of a patient supported by the conforming assembly) about one or more longitudinal axes (and optionally one or more transverse axes) to generally maximize patient comfort by, for example, reducing any tendency for the patient's upper torso to twist into a face-down position.

For example, in an embodiment of an adaptive positioning system that is schematically illustrated herein, a first functional portion of the conforming assembly comprises a first longitudinal element that provides support primarily for a patient's back, thereby supporting a first portion of the patient's weight. Simultaneously, a second functional portion of the conforming assembly comprises a second longitudinal element that provides support primarily for the patient's lower side, thereby supporting a second portion of the patient's weight. The magnitude of the first portion of the patient's weight supported by the conforming assembly can be smoothly adjusted to reduce any tendency for the upper torso of a particular patient to twist into a face-down position.

Smoothly adjusting the magnitude of the first portion of a patient's weight supported by the conforming assembly may require continuous adjustment of the angular position of the conforming assembly (relative, e.g., to support means) about a longitudinal axis, and/or adjustment of the relative spatial relationship of the first functional portion of the conforming assembly with respect to the second functional portion of the conforming assembly. In general, these variables, plus (optionally) the angular position of the conforming assembly about a transverse axis (relative, e.g., to support means), may be adjusted for a particular patient to maximize the patient's comfort and reduce any tendency for the patient's upper torso to twist into a face-down position. Note that since the conforming assembly can be adapted to generally conform to a laterally recumbent patient in providing both back and lower side support, rotation of the conforming assembly about a longitudinal axis (or optionally a transverse axis) tends to rotate the supported patient in a similar manner.

In the above illustrative example, the minimum magnitude of conforming assembly support for the first portion of a particular patient's weight is an empirically determined magnitude required to achieve a desired reduction of the tendency for the patient's upper torso to twist into a face-down position. This minimum magnitude of conforming assembly support is achieved by compensatory rotation about a longitudinal axis that is just sufficient to counteract (i.e., to compensate for) the tendency for that particular patient's upper torso to twist into a face-down position. A desired degree of such compensatory longitudinal rotation of the conforming assembly (and the patient) may be estimated by using one or more pressure sensors to measure pressure exerted on the first functional portion of the conforming assembly (which primarily supports the patient's back). Should this measured pressure(s) fall below a predetermined value, compensatory longitudinal rotation may be used to increase the magnitude of conforming assembly support for the first portion of the patient's weight, as indicated by increasing the measured pressure on the first portion of the conforming assembly, to the above-described minimum.

As an alternative or supplement to the above pressure measurement, a sensor may be used to measure the torque exerted by the first portion of a conforming assembly on the second portion of the conforming assembly. If the first and second functional portions of a conforming assembly are joined by a reversibly lockable longitudinal hinge, and if only the second functional portion of the conforming assembly is directly (adjustably) fixed to and supported by at least one frame member, then the measured torque across the locked longitudinal hinge will generally be a function of the first portion of the patient's weight supported by the conforming assembly. Should the patient's upper torso begin to twist into a face-down position (due, for example, to muscle relaxation when the patient falls asleep), the measured value of torque across the hinge would decrease below a predetermined value, signaling a need for compensatory longitudinal rotation of the conforming assembly (and the patient). Such compensatory longitudinal rotation adaptively increases the first portion of weight supported by the conforming assembly sufficiently to counteract any upper torso twist thus detected.

In various embodiments of the positioning system, the process of pressure and/or torque measurement described above, followed by compensatory rotation of an conforming assembly (and a patient), may be accomplished manually (e.g., by an observer who monitors the patient's position or by the patient) or automatically (e.g., by a control means designed to maintain measured torque and/or pressure at predetermined values). A subset of such predetermined valves may be designated as set points which may be empirically determined for each patient to reduce to a desired extent any tendency for that patient's upper torso to twist into a face-down position due, for example, to slight patient movement.

Since conscious or unconscious movement is to be expected from time to time in a resting patient, these set points will typically vary over time in different patients.

Referring to the above illustrative example, manual or automatic control of compensatory conforming assembly rotation may be supplemented or replaced by continuous adaptive adjustment of the relative angular relationships between longitudinal elements of the first and second portions of a conforming assembly. Such adjustment may increase patient comfort and is facilitated by reversibly lockable hinges joining adjacent longitudinal elements and/or by fixing adjacent longitudinal elements within a rigid frame. Such relative angular relationship adjustments may involve alteration of the manner in which longitudinal elements are adjustably fixed within a rigid frame, and they are also facilitated in certain embodiments by reversibly lockable longitudinal hinges joining longitudinal elements edge-to-edge.

In general, each longitudinal hinge of a conforming assembly joins adjacent edges of a pair of longitudinal elements, thereby allowing rotation of these adjacent longitudinal elements with respect to each other about a longitudinal axis. If such a hinge is reversibly lockable, a smoothly adjustable relative angular relationship (i.e., a relative angular relationship that may be smoothly changed to a desired state and then temporarily fixed in that state) may be established between those two adjacent longitudinal elements. In a conforming assembly in which all longitudinal elements are joined edge-to-edge with reversibly lockable hinges, relative angular relationships among all longitudinal elements of the conforming assembly can be smoothly adjusted and temporarily fixed, whether the longitudinal elements are adjacent or non-adjacent. Further, at least one frame member may be coupled to only a single longitudinal element (or a set or subset of all longitudinal elements in the conforming assembly) to provide the required support for the conforming assembly and the patient and to allow continuous adjustment of the rotation angle of the conforming assembly about one or more longitudinal axes (and optionally about one or more transverse axes). Thus, a relatively rigid conforming assembly is created that may be smoothly rotated (with a patient) about a longitudinal axis and/or a transverse axis independent of the (temporarily) fixed relative angular relationship(s) between functional portions of the conforming assembly.

Smoothly adjustable rotation of the conforming assembly about a longitudinal axis can smoothly transfer an adjustable portion of the weight of a laterally recumbent patient from the patient's side to the patient's back or vice versa. Sufficient weight support may thus be provided through the patient's back to substantially reduce the tendency for the patient's upper body twist the patient's spine by rotating toward a face-down position during sleep. In other words, a first portion of the patient's own weight acts to maintain the patient's back in comfortable contact primarily with the first functional portion of the conforming assembly. And while such comfortable contact is maintained, the patient's upper torso will tend not to rotate into a face-down position. Simultaneously, a second portion of the patient's weight is primarily supported by the second functional portion of the conforming assembly through the patient's side, thereby allowing the patient to establish and maintain a resting posture with knees and hips flexed to relieve lower back pain.

Note that adjacent edges of a conforming assembly's longitudinal elements may or may not be joined. When not joined, such edges may be maintained adjacent (but still adjustable) by being temporarily fixed in a rigid frame. The manner in which the longitudinal elements are temporarily fixed in such a frame may be, for example, by adjustably fixing the ends and/or by allowing limited rotational movement of the ends in their attachment to the relatively rigid frame to form a framed conforming assembly. Alternatively one or more longitudinal elements may be hinged, but not locked, to longitudinal elements that are themselves fixed in a frame to form a free-form conforming assembly.

If a smoothly adjustable relative angular relationship is temporarily fixed between at least the outermost two longitudinal elements of the conforming assembly, then the resulting patient support surface will have a degree of flexibility related to the number of hinged-but-unlocked and/or adjacent-but-not-hinged longitudinal joints between the outermost two longitudinal elements. Such a conforming assembly may conform even more closely to a patient and may adapt to patient movement by alteration of the relative angular relationship of one or more pairs of longitudinal elements between the outermost two longitudinal elements while simultaneously supporting the patient's weight distributed as desired between first and second functional portions of a conforming assembly.

An adaptive positioning system may then comprise a choice of conforming assembly configurations for supporting the patient. Further, one or more longitudinal elements of a conforming assembly, or the rigid frame of a framed conforming assembly, may be coupled to and supported by support means in a manner analogous to that schematically illustrated herein, or in any other manner known to those skilled in the art, provided that first and second portions of the patient's weight are safely and comfortably supported in a desired (smoothly adjustable) distribution by first and second functional portions of a conforming assembly respectively. Further, smoothly adjustable compensatory longitudinal rotation (and optionally transverse rotation) must be allowed. Thus, support means may be coupled to and provide support along two longitudinal support axes, the support axes being spaced apart laterally. In other embodiments, a single longitudinal support axis may be used. By smoothly adjusting the coupling between the support means and the longitudinal support axis or support axes, the conforming assembly can be rotated about a transverse axis and/or a longitudinal axis parallel to or coincident with one of the longitudinal support axes.

Note that rotation of a laterally recumbent patient supported by any configuration of a conforming assembly approximately ninety degrees about a longitudinal axis can substantially interchange the support functions of the first and second functional portions of the conforming assembly as described in the above illustrative example. That is, the first functional portion of the conforming assembly may become the portion that primarily supports the patient's lower side), and the second functional portion of the conforming assembly may become the portion that primarily supports the patient's lower side. By providing an appropriately strengthened conforming assembly, this interchange of patient support functions can be accommodated by an adaptive positioning system so as to allow a patient to transition easily from a left lateral recumbent position to a right lateral recumbent position and vice versa. In such embodiments, a third functional portion of the conforming assembly may be desirable to support the patient during transitions between left and right lateral recumbent positions.

DETAILED DESCRIPTION

Figure 1:
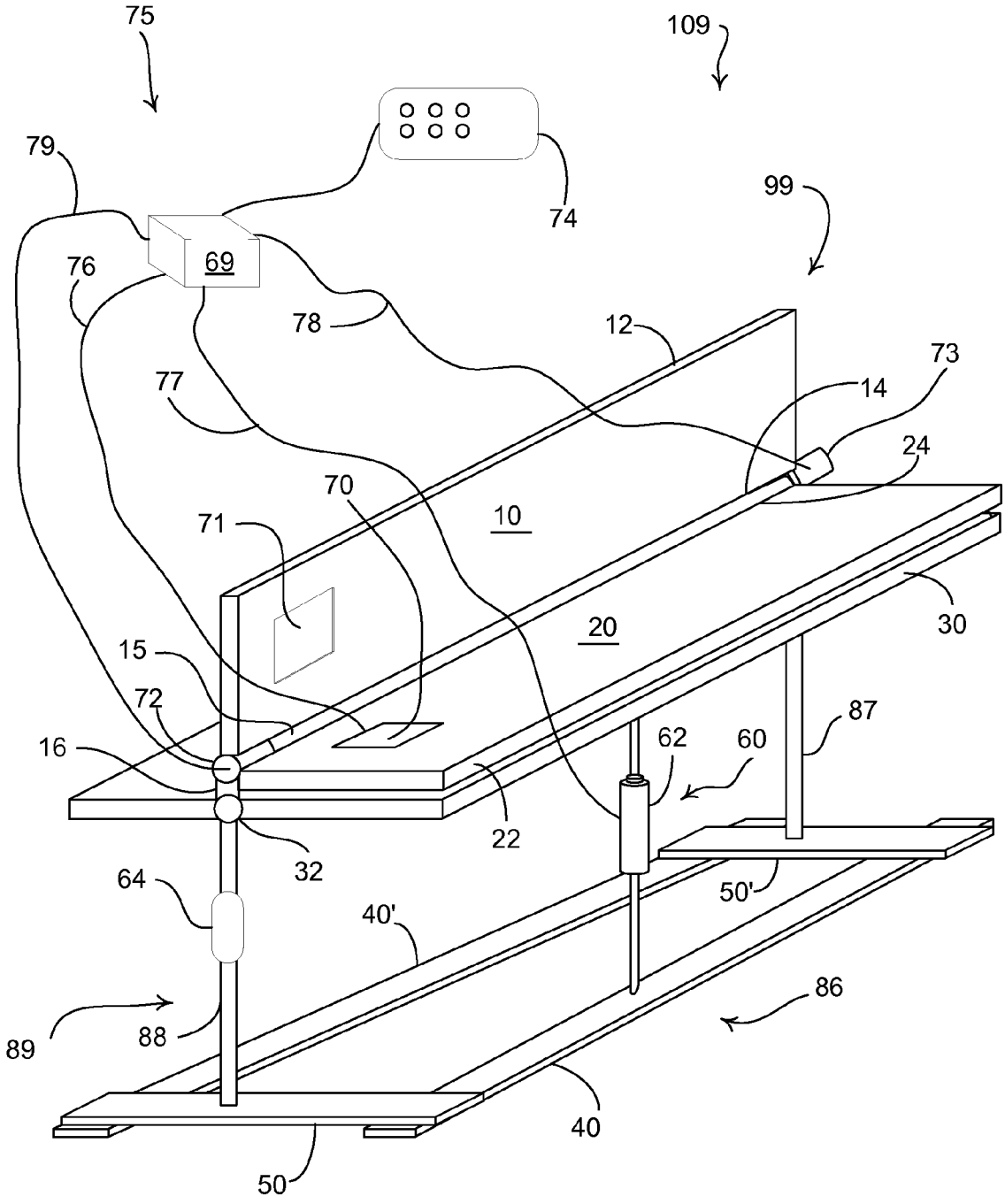
FIG. 1 is a schematic view of an adaptive positioning system comprising longitudinal elements, a frame member, a stand-off link, support means, rotation means and control means.

A schematically illustrated adaptive positioning system embodiment 109 is shown in FIG. 1 and comprises a conforming assembly 99 which acts as an articulated surface capable of supporting, and generally conforming to, a person. Conforming assembly 99 comprises two substantially planar longitudinal elements 10 and 20 having an adjustably fixed spatial relationship to frame member 30. Frame member 30, in turn, is supported on longitudinal bearing 32.

A reversibly lockable hinge 15 is segmented to facilitate reversibly lockable connection of frame member 30, (optionally via stand-off link 16), to first longitudinal edge 14 of longitudinal element 10 and to second longitudinal edge 24 of longitudinal element 20. When present, stand-off link 16 allows planar longitudinal elements 10 and 20 to be oriented substantially parallel to and spaced apart from frame member 30 (see, e.g., FIGS. 1 and 7).

Conforming assembly 99 has first and second side edges 22 and 12 respectively. Longitudinal element 10 comprises a port 71 for allowing access to a person supported on conforming assembly 99, and longitudinal element 20 comprises distributed pressure sensor 70. Angular rotation sensor 72 senses the angular positions about reversibly lockable hinge 15 of planar longitudinal elements 10 and 20. Torque sensor 73 senses torque about reversibly lockable hinge 15 exerted by planar longitudinal elements 10 and 20. When stand-off link 16 is absent or relatively short, the algebraic sum of torques exerted about reversibly lockable hinge 15 by planar longitudinal elements 10 and 20 approximates torque exerted about longitudinal bearing 32 by conforming assembly 99. An estimate of torque exerted about longitudinal bearing 32 by conforming assembly 99 (and any person supported thereby) may be obtained as a function of force exerted by fluid-actuated cylinder 62, such force being a function of fluid pressure in cylinder 62 and transmission line 77.

Support means 89 comprises a longitudinal bearing 32 supported by first and second bearing supports 88 and 87, which are rigidly held substantially parallel and vertical by a base 86. The illustrated embodiment of base 86 comprises two longitudinal base members 40 and 40' connected by two transverse base members 50 and 50'. Note that the lengths of first and/or second bearing supports 88 and 87 can optionally be adjusted manually or automatically via one or more adjustable length elements 64 which may optionally be incorporated to tilt conforming assembly 99 about a transverse axis. Such tilt, when desired, is facilitated by pivotal connection of bearing supports 88 and 87 to longitudinal bearing 32.

Rotation means 60 rotates frame member 30, and thus longitudinal elements 10 and 20, of conforming assembly 99 about a longitudinal axis (i.e., that of longitudinal bearing 32). A supported person (not shown) on conforming assembly 99 would thus be analogously rotated about a longitudinal axis. Rotation means 60 comprises a fluid-actuated cylinder 62 pivotally mounted between a longitudinal base member 40 of base 86 and frame member 30 of conforming assembly 99.

Control means 75 generates a control signal for controlling fluid-actuated cylinder 62 of rotation means 60. To facilitate control of rotation means 60, control means 75 comprises a set point input device 74 (in this embodiment, a keyboard) connected to processor 69, and transmission lines 76, 77, 78 and 79. The transmission lines are for carrying the control signal to rotation means 60 (transmission line 77) and for carrying weight distribution information (e.g., variables related to weight distribution) from conforming assembly 99 (transmission lines 76, 78 and 79). The control signal for the illustrated embodiment comprises pressurized fluid (not shown) which is transmitted to fluid-actuated cylinder 62 of rotation means 60 via transmission line (e.g., a pipe) 77. The control signal encodes at least one set point (entered via set point input device 74) and a function of (variables related to) weight distribution on conforming assembly 99. Variables related to such weight distribution for the illustrated embodiment are generated by distributed pressure sensor 70 on longitudinal element 20, torque sensor 73 for sensing torques on reversibly lockable hinge 15, and angular rotation sensor 72 on reversibly lockable hinge 15.

Referring to reversibly lockable hinge 15 connecting first longitudinal edge 14 of longitudinal element 10 to second longitudinal edge 24 of longitudinal element 20, a variety of reversibly lockable hinges known to those skilled in the art may be used. One example is the hinge-type angle setting device described in the '417 patent. Note that the angle setting devices of the '417 patent is smoothly and substantially continuously adjustable to establish or change a desired relative angular relationship between the structures so hinged. Further, the hinge of the '417 patent is reversibly temporarily lockable at a desired relative angular relationship simply by leaving the actuator in a temporarily fixed position. This may be accomplished, for example, by manually clamping the actuator or by controlling the actuator via a high-mechanical-advantage linkage (such as a worm-drive gear motor) that remains in a stable state in the absence of power input. The latter configuration is not shown but could be used in an automatic control system. Note also that the angle setting devices of the '417 patent could be used to impart continuously adjustable compensatory longitudinal rotation to conforming assembly 99, either manually or automatically.

After longitudinal element 10 (the first functional portion of illustrated conforming assembly 99) is rotated with respect to longitudinal element 20 (the second functional portion of illustrated conforming assembly 99), establishing a relative angular relationship between the first and second functional portions that adapts positioning system 109 for the patient, reversibly lockable hinge 15 is reversibly locked. Conforming assembly 99 is then typically smoothly rotated about a longitudinal axis (that is, rotated about longitudinal bearing 32 in the illustrated embodiment), smoothly adjusting this longitudinal rotation until the first portion of the laterally recumbent patient's weight just exceeds a minimum magnitude.

Note that this continuously adjustable longitudinal rotation of conforming assembly 99 may be independent of the adjustable relative angular relationship established between the first and second functional portions of conforming assembly 99. That is, the angular relationship may be held constant while longitudinal rotation is continuously varied. Conversely, longitudinal rotation may be held constant while the relative angular relationship is continuously varied. But since the desired minimum magnitude of the first portion of the patient's weight may be influenced by both the longitudinal rotation variable and the relative angular relationship variable, these variables may be optimized by serial or simultaneous adjustment, either manual or automatic, to maximize patient comfort and/or to minimize pain.

The desired minimum magnitude of the first portion of supported weight required for an individual patient may be empirically determined as the magnitude just sufficient to compensate for the tendency of the patient's upper torso to twist into a face-down position. This minimum magnitude is ordinarily revised from time-to-time so as to adapt to the patient's movements as they change the need for compensatory longitudinal rotation.

Longitudinal rotation is facilitated in the illustrated embodiment by longitudinal bearing 32, which is part of support means 89 and rotatably supports second longitudinal element 20 near its longitudinal edge 22. Thus, second longitudinal element 20 may longitudinally rotate about, and simultaneously be partially supported by, longitudinal bearing 32. Such longitudinal rotation of second longitudinal element 20 is controlled in this embodiment by rotation means 60 (comprising fluid-actuated cylinder 62, which is pivotally mounted between support means 89 and a point near longitudinal edge 24 of longitudinal element 20).

The schematically illustrated positioning system 109 comprises a distributed pressure sensor 70 on longitudinal element 20 for sensing a portion of a patient's weight being supported by longitudinal element 20. Several embodiments of distributed pressure sensor 70 are known to those skilled in the art. An example is described in U.S. Pat. No. 5,799,533, incorporated herein by reference.

The schematically illustrated positioning system 109 further comprises a torque sensor 73 and an angular rotation sensor 72 connected to reversibly lockable hinge 15 for indicating variables which may comprise a function of weight distribution on conforming assembly 99. In the configuration of conforming assembly 99 that is schematically illustrated in FIG. 1, torque sensor 73 is used in estimating the portion of a supported person's weight being supported by longitudinal element 10 through torque exerted on reversibly lockable hinge 15 by longitudinal element 10. Angular rotation sensor 72, which provides information on the relative angular relationship between longitudinal element 10 and longitudinal element 20, is also used in estimating the portion of a supported person's weight being supported by longitudinal element 10. Several embodiments of torque sensor 73 and angular rotation sensor 72 are known to those skilled in the art. For example, an embodiment which senses torque as a function of measured strain (specifically capacitively-measured torsional strain), is described in U.S. Pat. No. 6,601,462 B1, incorporated herein by reference. Relative angular rotation, on the other hand, is often sensed using devices incorporating rotary potentiometers, rotary switches, rotary counters and/or rotary transformers.

Figure 2A:
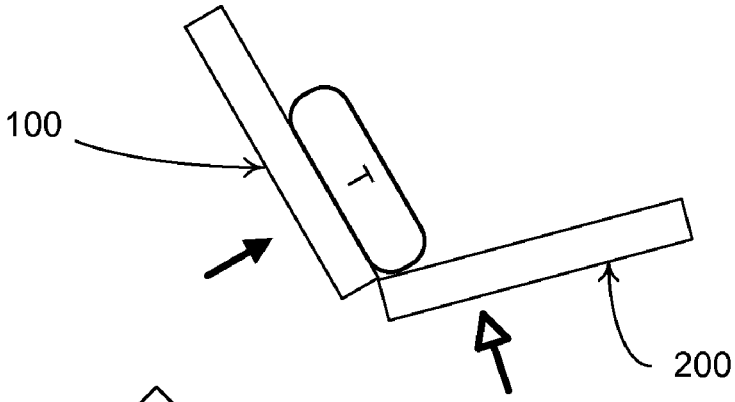
FIGS. 2A-2E schematically illustrate a series of partial cross-sections of a patient's upper thorax as supported by a first functional conforming assembly portion and a second functional conforming assembly portion during a typical transition from a right lateral recumbent position (FIG. 2A) to a left lateral recumbent position (FIG. 2E).
Figure 2B:
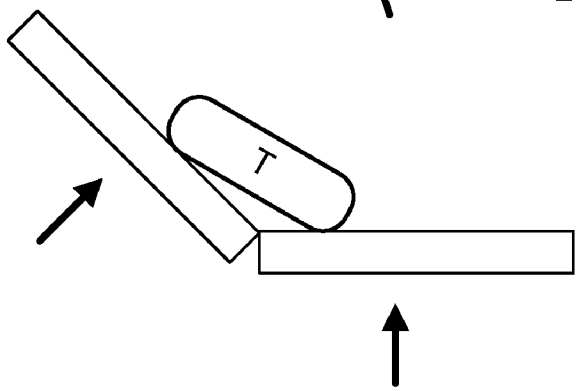
Figure 2C:
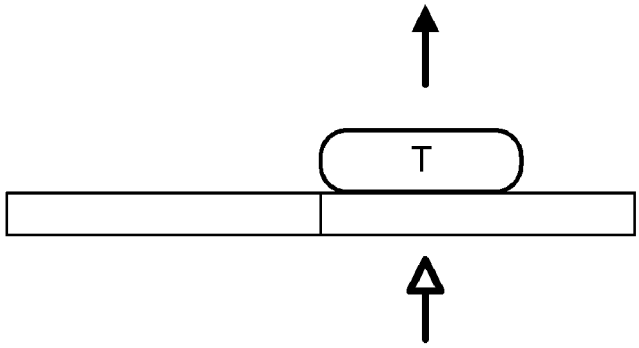
Figure 2D:
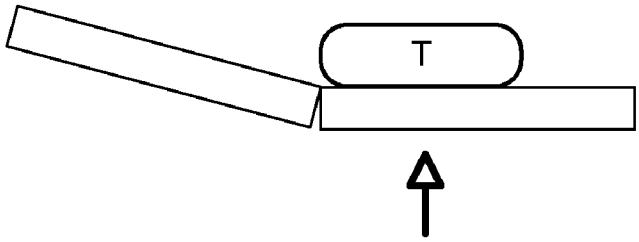
Figure 2E:
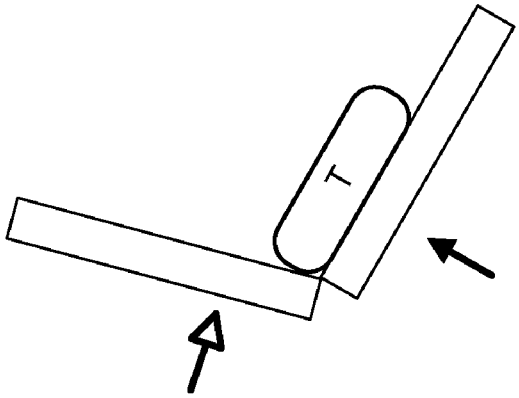

FIGS. 2A-2E illustrate an example series of schematic partial cross-sections of a patient's upper thorax T supported by a first functional conforming assembly portion 100 (on the left in the illustrations) and a second functional conforming assembly portion 200 (on the right in the illustrations) during a typical patient's transition from a right lateral recumbent position (FIG. 2A) to a left lateral recumbent position (FIG. 2E). The illustrations are intended only to be broadly representative of a typical transition. Actual angular positions of functional portions 100 and 200, as well as the actual patient position at each stage and the actual weight distribution between functional portions 100 and 200, will be specific for each actual patient. The short straight dark arrows perpendicular to functional portions 100 and 200 schematically indicate the changing relative amounts of support typically provided to a patient by each functional portion during the transition. Note that a variably inflatable and/or gel-filled longitudinal cushion between the patient and functional portions 100 and 200 may provide additional patient support and comfort, while facilitating lateral patient movement during the transition.

FIG. 2A shows schematically that the portion of patient weight supported by functional portion 200 (indicated by the hollow-headed arrow) is relatively larger than the portion of patient weight supported by functional portion 100 (indicated by the solid-headed arrow). In FIG. 2B the patient's weight is roughly evenly distributed between functional portions 100 and 200, and the patient will have a tendency to slide laterally right from the position shown in FIG. 2B to the position shown in FIG. 2C where all of the patient's weight is supported by functional portion 200. Since a patient will generally be capable of at least limited movement, appropriate adjustment of the relative angular relationship between functional portions 100 and 200 makes use of gravity to assist the patient's lateral slide while allowing the patient to control the slide so as to come to rest in the position shown in FIG. 2C. To continue with the transition, functional portion 100 is rotated clockwise with respect to functional portion 200 in FIG. 2D. While this rotation of functional portion 100 does not change the support of all of the patient's weight by functional portion 200, it does prepare for the subsequent counter-clockwise rotation of functional portion 200 which will transfer a relatively larger portion of the patient's weight support to functional portion 100, leaving a relatively smaller portion to be supported by functional portion 200. The clockwise rotation of functional portion 100 shown in FIG. 2D tends to resist any lateral slide of the patient to the left during subsequent counter-clockwise rotation of functional portion 200 to the position shown in FIG. 2E. Note that the relative angular positions of functional portions 100 and 200 in FIG. 2E is virtually a mirror image of their respective positions in FIG. 2A, signifying completion of the transition from right lateral recumbent to left lateral recumbent. Note also that an actual patient smoothly transitions among positions analogous to (but not necessarily identical to) the positions illustrated in FIGS. 2A-2E. To maximize comfort and/or minimize pain during a transition, the patient (or an observer or an automatic control system) may pause for an indefinite or predetermined period in any position analogous to an illustrated position or in any position intermediate between the illustrated positions.

Figure 3:
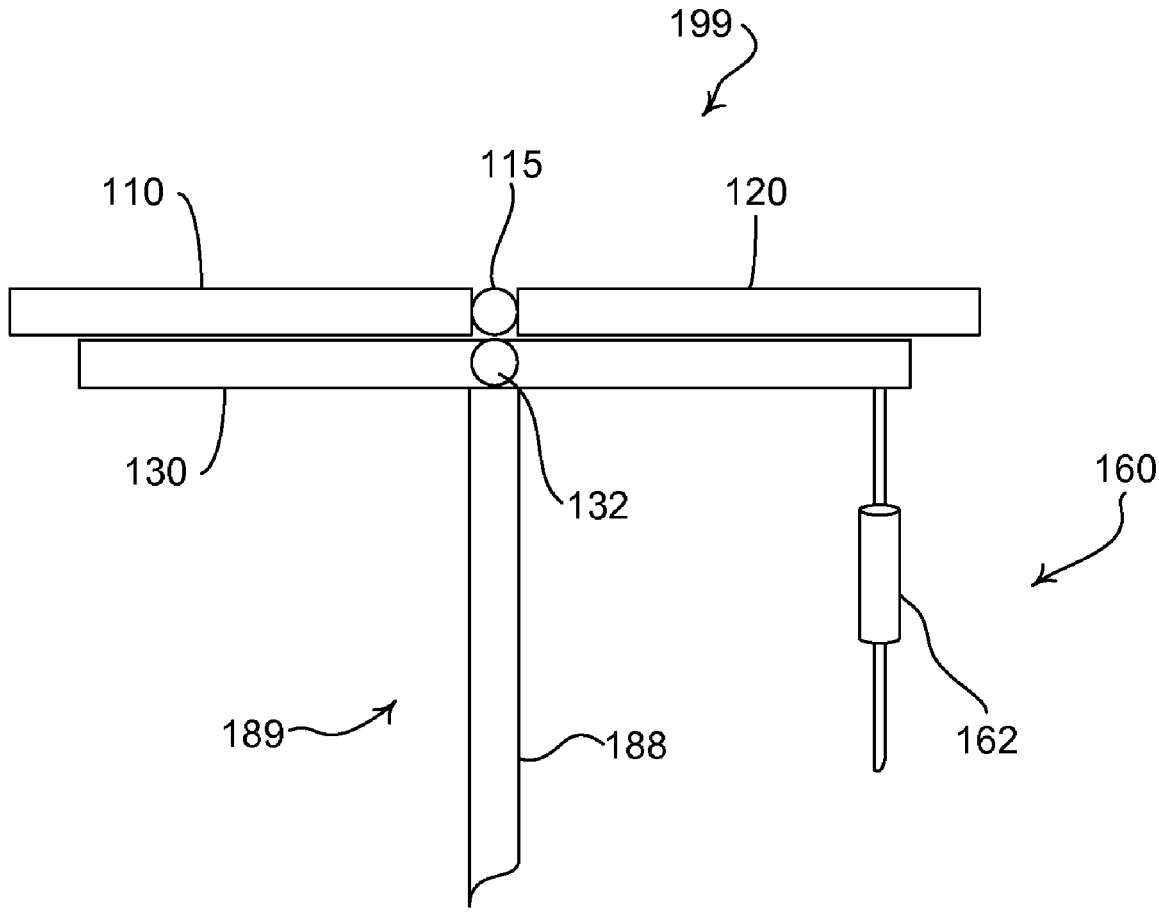
FIG. 3 schematically illustrates a partial end-on view of an embodiment of a conforming assembly comprising two longitudinal elements that are adjustably fixed parallel to a frame member.

FIG. 3 schematically illustrates a partial end-on view of an embodiment of a conforming assembly 199 comprising two longitudinal elements 110 and 120 adjustably fixed parallel to a frame member 130 via reversibly lockable hinge 115. Conforming assembly 199 is supported by support means 189, which comprises longitudinal bearing 132 and bearing support 188 (shown partially), together with base members (not shown) which relatively rigidly hold bearing support 188 vertical. Rotation means 160 comprises fluid-actuated cylinder 162 which is pivotally-mounted to frame member 130 and to one or more base members (not shown).

Figure 4:
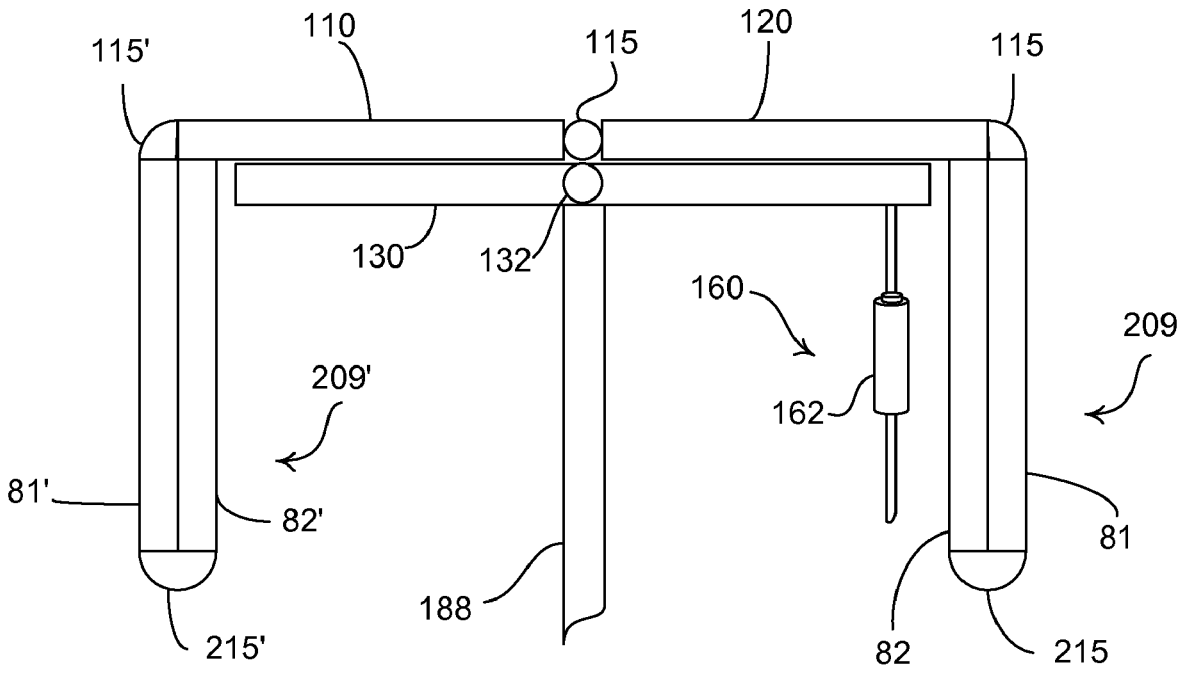
FIG. 4 schematically illustrates a partial end-on view of the conforming assembly embodiment of FIG. 3, but additionally comprising first and second lateral reverse-foldable longitudinal assemblies.

FIG. 4 schematically illustrates a partial end-on view of the conforming assembly embodiment of FIG. 3, but additionally comprising first and second lateral reverse-foldable longitudinal assemblies 209 and 209' pivotally, and reversibly-lockably, connected longitudinally edge-to-edge to longitudinal elements 120 and 110 respectively. As illustrated, reversibly-lockable pivotal connection of first and second lateral reverse-foldable longitudinal assemblies 209 and 209' to longitudinal elements 120 and 110 respectively is achieved by reversibly-lockable longitudinal hinges 115 and 115' respectively.

Lateral reverse-foldable longitudinal assemblies 209 and 209' comprise, in turn, inner foldable elements (81 and 81' respectively) pivotally, and reversibly-lockably, connected longitudinally (e.g., by reversibly-lockable longitudinal hinges 215 and 215' respectively, as illustrated) to outer foldable elements (82 and 82' respectively, as illustrated). Lateral reverse-foldable longitudinal assemblies 209 and 209' can rotate about longitudinal axes from reversibly-lockable first positions (analogous, for example, to the respective positions in FIG. 4) to "bed rail" and "raised" positions such as the general forms of the left and right assemblies of FIG. 5 respectively. Note that the outer foldable element of the left assembly of FIG. 5 is reverse-folded compared to the analogous element shown in FIG. 4.

Figure 6:
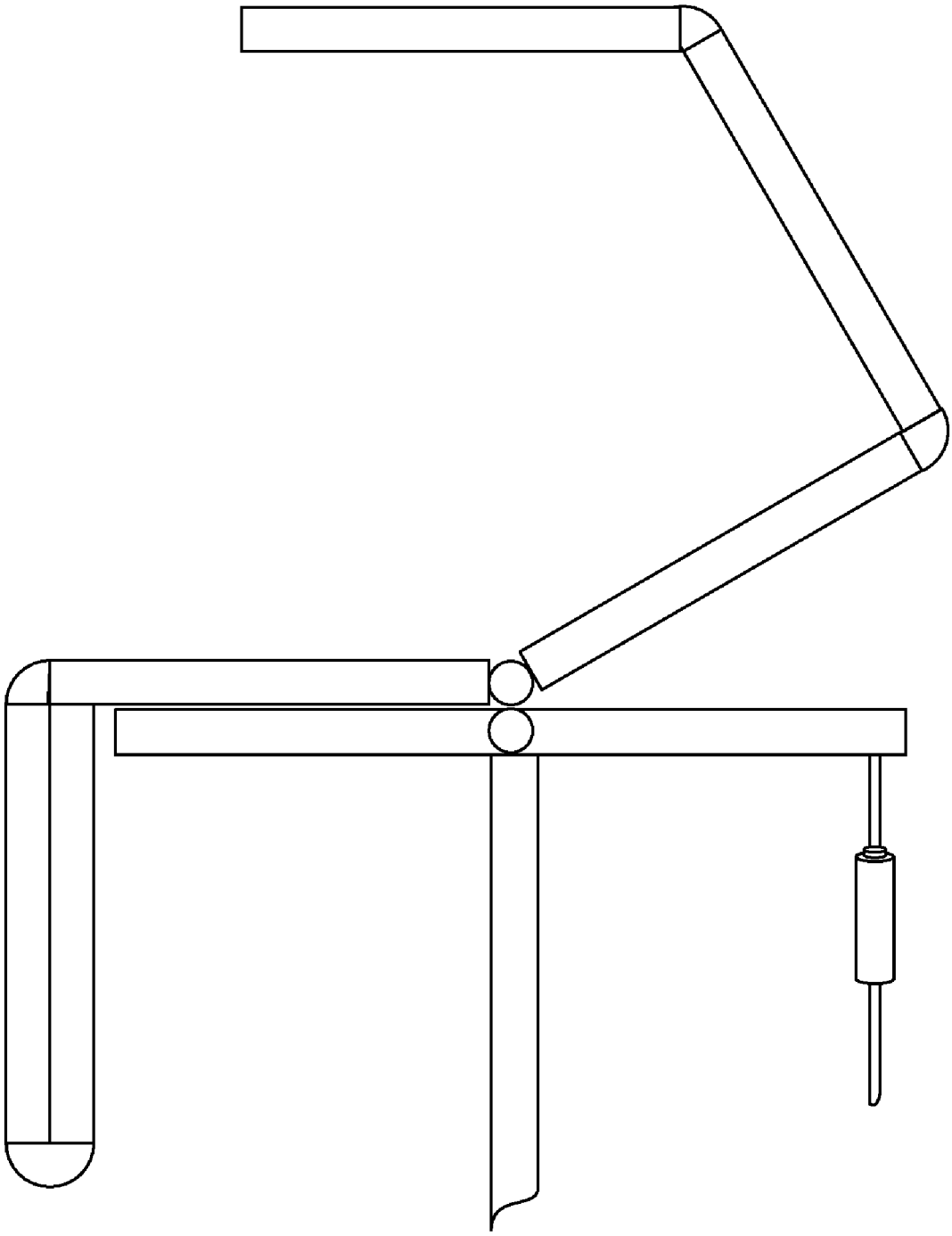
FIG. 6 schematically illustrates a partial end-on view of the general form of the conforming assembly embodiment of FIG. 5 wherein one of the lateral reverse-foldable longitudinal assemblies has been further extended for supporting weight over a longitudinal element.

From the above "raised" position, an outer foldable element may be extended to a reversibly-lockable position capable of supporting weight over a portion of a conforming assembly (analogous, for example, to the general form of the extended position of the right assembly of FIG. 6). In certain embodiments (not shown), first and second lateral reverse-foldable longitudinal assemblies may be extended from the first and second edges of a conforming assembly respectively so as to allow them to be temporarily joined longitudinally, edge-to-edge, (as, for example, by one or more clamps (not shown)) to support greater weight than that supportable by a single such assembly over a portion of a conforming assembly.

Figure 5:
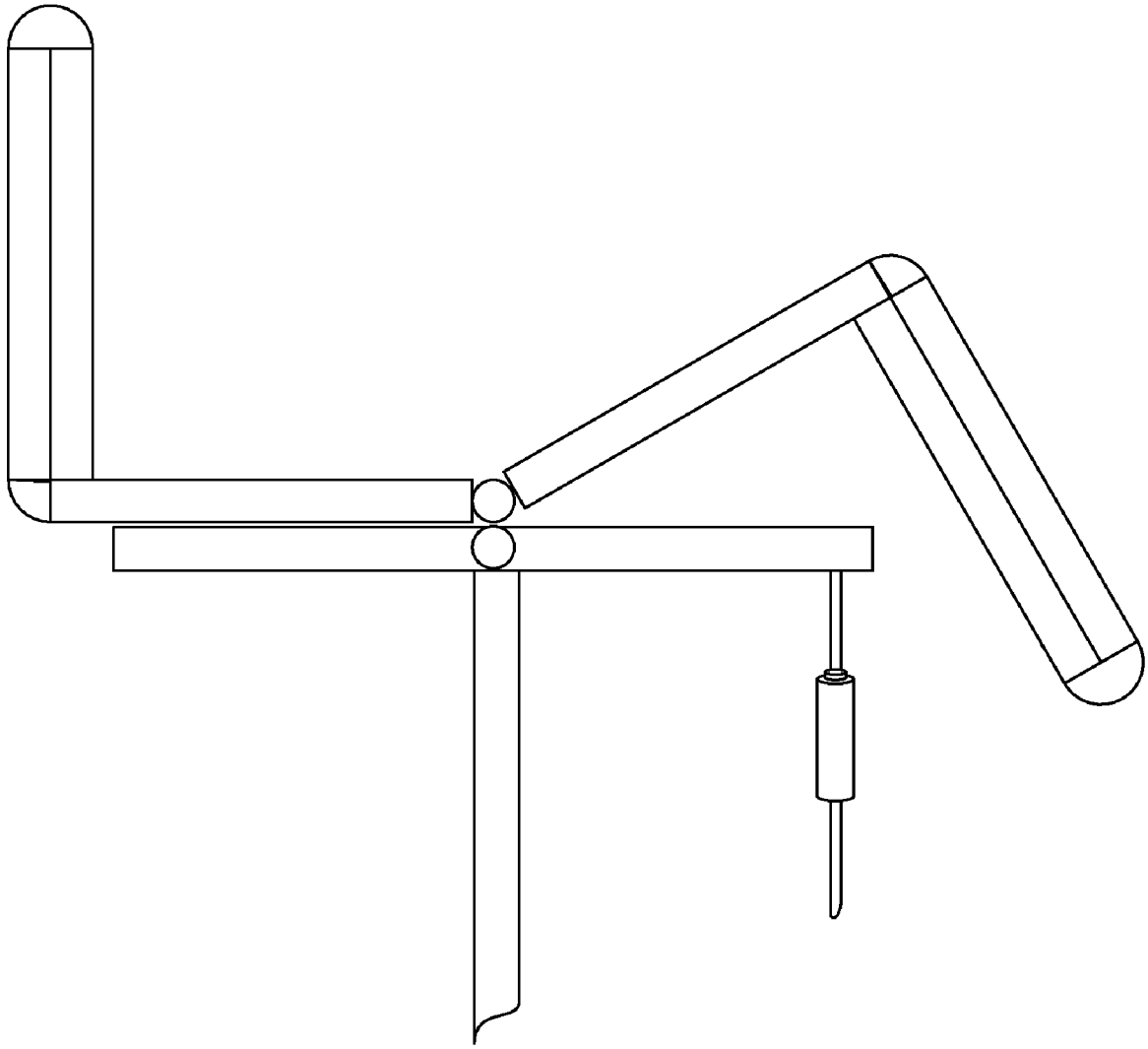
FIG. 5 schematically illustrates a partial end-on view of the general form of the conforming assembly embodiment of FIG. 4 wherein one of the lateral reverse-foldable longitudinal assemblies has been raised in preparation for further extension.
Figure 7:
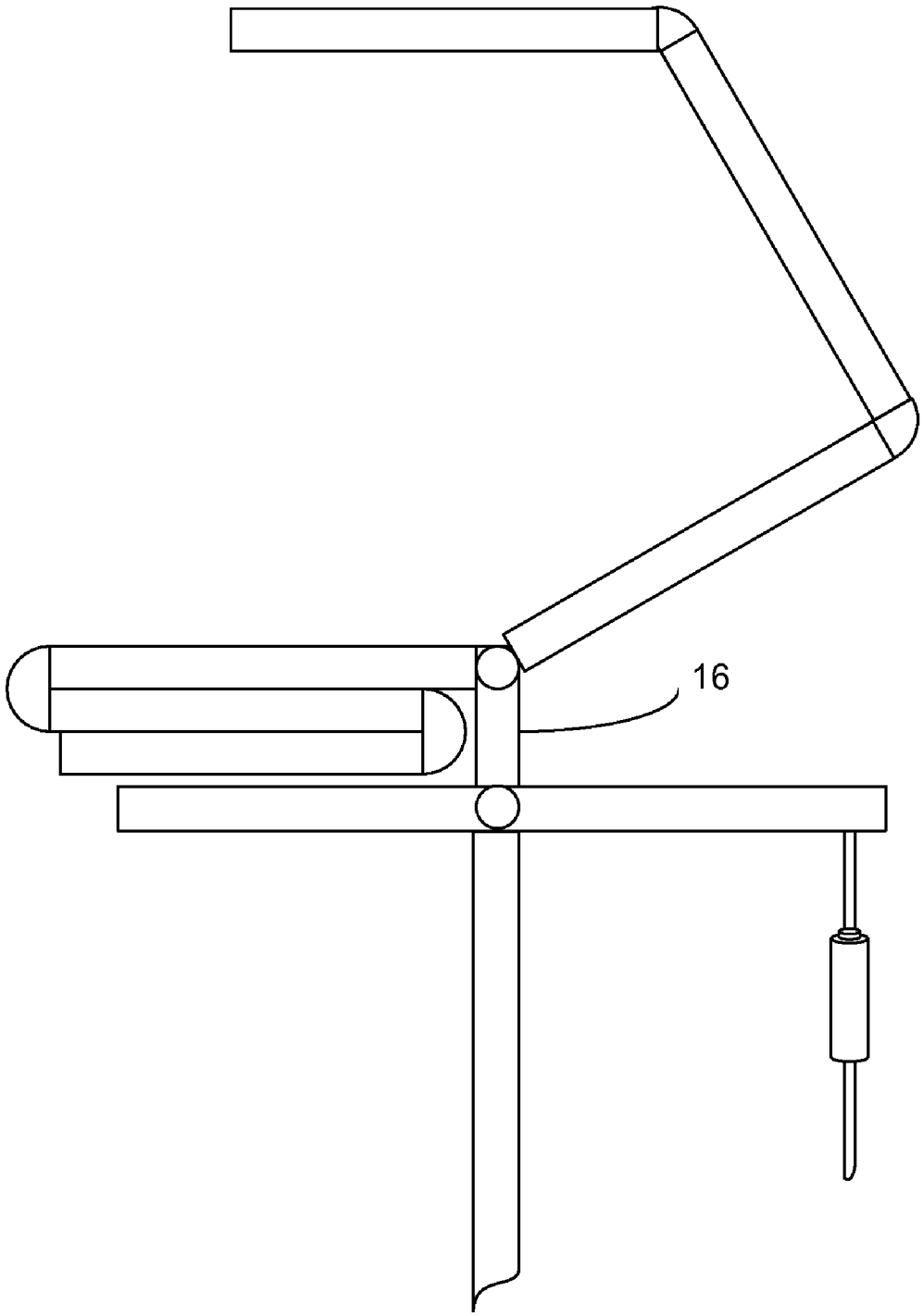
FIG. 7 schematically illustrates a partial end-on view of the general form of a conforming assembly embodiment comprising one lateral reverse-foldable longitudinal assembly which has been extended for supporting weight over a longitudinal element, and another lateral reverse-foldable longitudinal assembly which has been folded away between a longitudinal element and a frame member, the longitudinal element and the frame member being spaced apart by a stand-off link.
Figure 8:
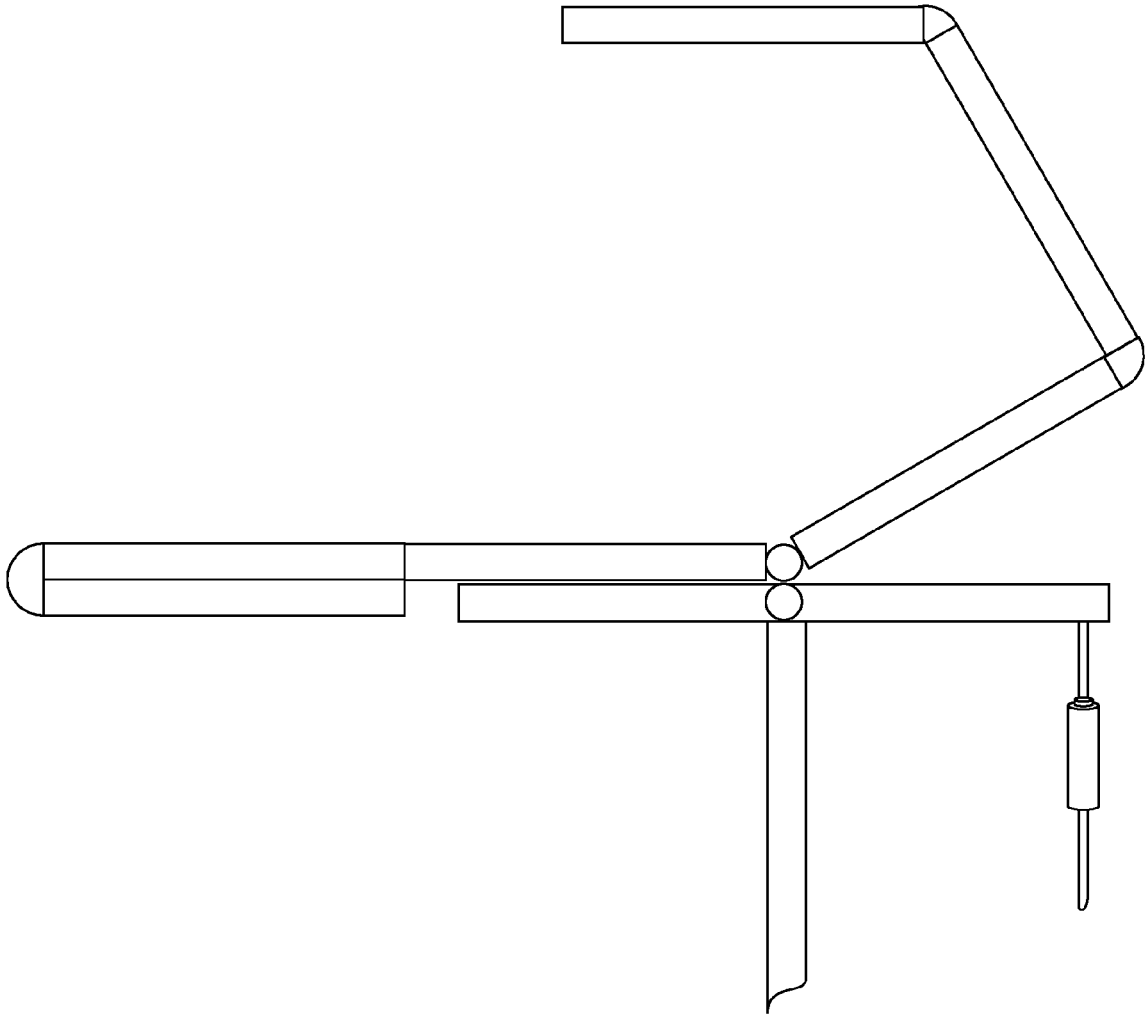
FIG. 8 schematically illustrates a partial end-on view of the general form of a conforming assembly embodiment comprising one lateral reverse-foldable longitudinal assembly which has been extended for supporting weight over a longitudinal element, and another lateral reverse-foldable longitudinal assembly which has been reversibly-locked in position to assist personal movement to or from a conforming assembly.

Note also that a lateral reverse-foldable longitudinal assembly having an inner foldable element somewhat narrower than the longitudinal element to which it is hinged may be reverse-folded in a manner analogous to the reverse-folding of the outer foldable element of the left assembly shown in FIG. 5 as noted above. Thus, the left assembly shown in FIG. 7 is then folded away in a space created by a stand-off link between a frame member and a longitudinal element generally in the form schematically illustrated. Alternatively, a lateral reverse-foldable longitudinal assembly may be reversibly-locked in a substantially horizontal position to assist personal movement to or from a conforming assembly, as schematically illustrated by the general form on the left portion FIG. 8.

What is claimed is:

1. An adaptive positioning system comprising a plurality of substantially planar longitudinal elements, each said longitudinal element having first and second longitudinal edges and first and second ends;

at least one frame member having an adjustably fixed spatial relationship with a plurality of said longitudinal elements to form a conforming assembly capable of supporting a person, said conforming assembly having first and second side edges; support means comprising at least one bearing for rotatably supporting said conforming assembly via said at least one frame member, said at least one bearing facilitating rotation of said conforming assembly about a longitudinal axis;

rotation means comprising at least one motive component for rotating said conforming assembly to a predetermined angular position about a longitudinal axis; and control means generating at least one control signal for controlling said rotation means; wherein at least one said conforming assembly side edge is hinged longitudinally to a lateral reverse-foldable longitudinal assembly comprising an inner foldable element pivotally and reversibly-lockably connected longitudinally to an outer foldable element.

2. The adaptive positioning system of claim 1 wherein said conforming assembly first and second side edges are hinged longitudinally to first and second lateral reverse-foldable longitudinal assemblies respectively, each said reverse-foldable longitudinal assembly comprising an inner foldable element pivotally and reversibly-lockably connected longitudinally to an outer foldable element.

3. The adaptive positioning system of claim 2 wherein said first and second lateral reverse-foldable longitudinal elements are temporarily joined for supporting a weight over a portion of said conforming assembly.

4. The adaptive positioning system of claim 1 wherein at least one said longitudinal element comprises a port for allowing access to a supported person.

5. The adaptive positioning system of claim 1 wherein said control means comprises at least one sensor for weight distribution.

6. The adaptive positioning system of claim 5 wherein said control means comprises at least one sensor for angular position.

7. The adaptive positioning system of claim 6 wherein said control means comprises at least one sensor for torque.

* * * * *